US008186162B2

(12) United States Patent
Rogers et al.

(10) Patent No.: US 8,186,162 B2
(45) Date of Patent: May 29, 2012

(54) ACOUSTICALLY TUNED COMBUSTION FOR A GAS TURBINE ENGINE

(75) Inventors: Thomas J. C. Rogers, San Diego, CA (US); Christopher Z. Twardochleb, Apline, CA (US); James W. Blust, San Diego, CA (US); Mario E. Abreu, Poway, CA (US); Donald J. Cramb, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 0 days.

(21) Appl. No.: 12/878,363

(22) Filed: Sep. 9, 2010

(65) Prior Publication Data

US 2010/0326080 A1 Dec. 30, 2010

Related U.S. Application Data

(60) Continuation of application No. 12/841,140, filed on Jul. 21, 2010, which is a division of application No. 11/239,376, filed on Sep. 30, 2005, now abandoned.

(51) Int. Cl.
*F02C 7/24* (2006.01)
*F02C 1/00* (2006.01)

(52) U.S. Cl. ..... 60/737; 60/725; 60/748

(58) Field of Classification Search ..... 60/740, 60/737, 804, 776, 752, 738, 748, 746, 747, 60/725; 431/114
See application file for complete search history.

(56) References Cited

U.S. PATENT DOCUMENTS 4,850,194 A * 7/1989 Fuglistaller et al. ..... 60/737
5,165,241 A * 11/1992 Joshi et al. ..... 60/737
5,251,447 A 10/1993 Joshi et al.
5,303,554 A 4/1994 Faulkner
5,351,477 A 10/1994 Joshi et al.
5,373,693 A 12/1994 Zarzalis et al.
5,435,126 A 7/1995 Beaudoin
5,467,926 A 11/1995 Idleman et al.
5,551,228 A * 9/1996 Mick et al. ..... 60/776
5,647,200 A 7/1997 Althaus
5,680,766 A * 10/1997 Joshi et al. ..... 60/746
5,778,676 A * 7/1998 Joshi et al. ..... 60/746
5,813,232 A 9/1998 Razdan et al.

(Continued)

OTHER PUBLICATIONS

Gas Turbine Overview, article, Sep. 27, 2005, 2 pages, http://mysolar.cat.com/cda/layout?m=35442&x=7.

(Continued)

*Primary Examiner* — Ehud Gartenberg
*Assistant Examiner* — Gerald Sung
(74) *Attorney, Agent, or Firm* — Finnegan, Henderson, Farabow, Garrett & Dunner LLP

(57) ABSTRACT

A fuel nozzle for a turbine engine has a central body member with a pilot, a surrounding barrel housing, a mixing duct and an air inlet duct. The fuel nozzle additionally has a main fuel injection device located between the air inlet duct and the mixing duct. The main fuel injection device is configured to introduce a flow of fuel into the barrel member to create a fuel/air mixture which is then premixed with a swirler. The fuel/air mixture then further mixes in the mixing duct and exits the nozzle into a combustor for combustion. The geometry of the fuel nozzle ensures that pressure waves from the combustor do not create a time varying fuel to air equivalence ratio in the flow through the nozzle that achieves a resonance with the pressure waves.

20 Claims, 3 Drawing Sheets

U.S. PATENT DOCUMENTS

| | | | | |
|---|---|---|---|---|
| 5,826,423 | A | 10/1998 | Lockyer et al. | |
| 5,943,866 | A | 8/1999 | Lovett et al. | |
| 6,052,986 | A | 4/2000 | Hoffmann et al. | |
| 6,073,436 | A | 6/2000 | Bell et al. | |
| 6,164,055 | A * | 12/2000 | Lovett et al. | 60/776 |
| 6,184,055 | B1 | 2/2001 | Yang et al. | |
| 6,205,764 | B1 | 3/2001 | Hermann et al. | |
| 6,216,466 | B1 | 4/2001 | Alkabie | |
| 6,269,646 | B1 * | 8/2001 | Lovett et al. | 60/737 |
| 6,363,724 | B1 * | 4/2002 | Bechtel et al. | 60/737 |
| 6,438,961 | B2 | 8/2002 | Tuthill et al. | |
| 6,532,742 | B2 | 3/2003 | Scarinci et al. | |
| 6,655,145 | B2 | 12/2003 | Boardman | |
| 6,698,206 | B2 | 3/2004 | Scarinci et al. | |
| 6,705,087 | B1 * | 3/2004 | Ohri et al. | 60/748 |
| 6,732,527 | B2 | 5/2004 | Freeman et al. | |
| 6,832,481 | B2 | 12/2004 | Koenig et al. | |
| 6,993,916 | B2 * | 2/2006 | Johnson et al. | 60/776 |
| 2003/0051478 | A1 | 3/2003 | Matsuyama et al. | |
| 2003/0115884 | A1 * | 6/2003 | Boardman | 60/776 |
| 2004/0006993 | A1 * | 1/2004 | Stuttaford et al. | 60/776 |
| 2007/0006587 | A1 * | 1/2007 | Ohta et al. | 60/746 |

OTHER PUBLICATIONS

Thomas Scarinci & Christopher Freeman, The Propagation of a Fuel-Air Ratio Disturbance in a Simple Premixer and Its Influence on Pressure Wave Amplification, May 8-11, 2000, 10 pages, 2000-GT-0106, ASME, Munich, Germany.

Thomas Scarinci, Christopher Freeman & Ivor Day, Passive Control of Combustion Instability in a Low Emissions Aeroderivative Gas Turbine, Jun. 14-17, 2004, 13 pages GT2004-53767, ASME, Vienna, Austria.

* cited by examiner

ACOUSTICALLY TUNED COMBUSTION FOR A GAS TURBINE ENGINE

This application is a continuation of U.S. patent application Ser. No. 12/841,140 filed Jul. 21, 2010, which is a divisional of U.S. patent application Ser. No. 11/239,376, filed Sep. 30, 2005, now abandoned.

TECHNICAL FIELD

The present disclosure relates generally to a turbine engine, and more particularly, to a turbine engine having an acoustically tuned fuel nozzle.

BACKGROUND

Internal combustion engines, including diesel engines, gaseous-fueled engines, and other engines known in the art, may exhaust a complex mixture of air pollutants. These air pollutants may be composed of gaseous compounds, which may include nitrous oxides (NOx). Due to increased attention on the environment, exhaust emission standards have become more stringent and the amount of NOx emitted to the atmosphere from an engine may be regulated depending on the type of engine, size of engine, and/or class of engine.

It has been established that a well-distributed flame having a low flame temperature can reduce NOx production to levels compliant with current emission regulations. One way to generate a well-distributed flame with a low flame temperature is to premix fuel and air to a predetermined lean fuel to air equivalence ratio. However, naturally-occurring pressure fluctuations within the turbine engine can be amplified during operation of the engine under these lean conditions. In fact, the amplification can be so severe that damage and/or failure of the turbine engine can occur.

One method that has been implemented by turbine engine manufacturers to provide lean fuel/air operational conditions within a turbine engine while minimizing the harmful vibrations generally associated with lean operation is described in U.S. Pat. No. 6,698,206 (the '206 patent) issued to Scarinci et al. on Mar. 2, 2004. The '206 patent describes a turbine engine having a primary combustion zone, a secondary combustion zone, and a tertiary combustion zone. Each of the combustion zones is supplied with premixed fuel and air by respective mixing ducts and a plurality of axially spaced-apart air injection apertures. These apertures reduce the magnitude of fluctuations in the lean fuel to air equivalence ratio of the fuel and air mixtures supplied into the mixing zones, thereby reducing the harmful vibrations.

Although the method described in the '206 patent may reduce some harmful vibrations associated with a low NOx-emitting turbine engine, it may be expensive and insufficient. In particular, the many apertures associated with each of the combustion zones described in the '206 patent may drive up the cost of the turbine engine. In addition, because the reduction of vibration within the turbine engine of the '206 patent does not rely upon strategic placement of the apertures according to acoustic tuning specific to the particular turbine engine, the reduction of vibration may be limited and, in some situations, insufficient.

DETAILED DESCRIPTION

Figure 1:
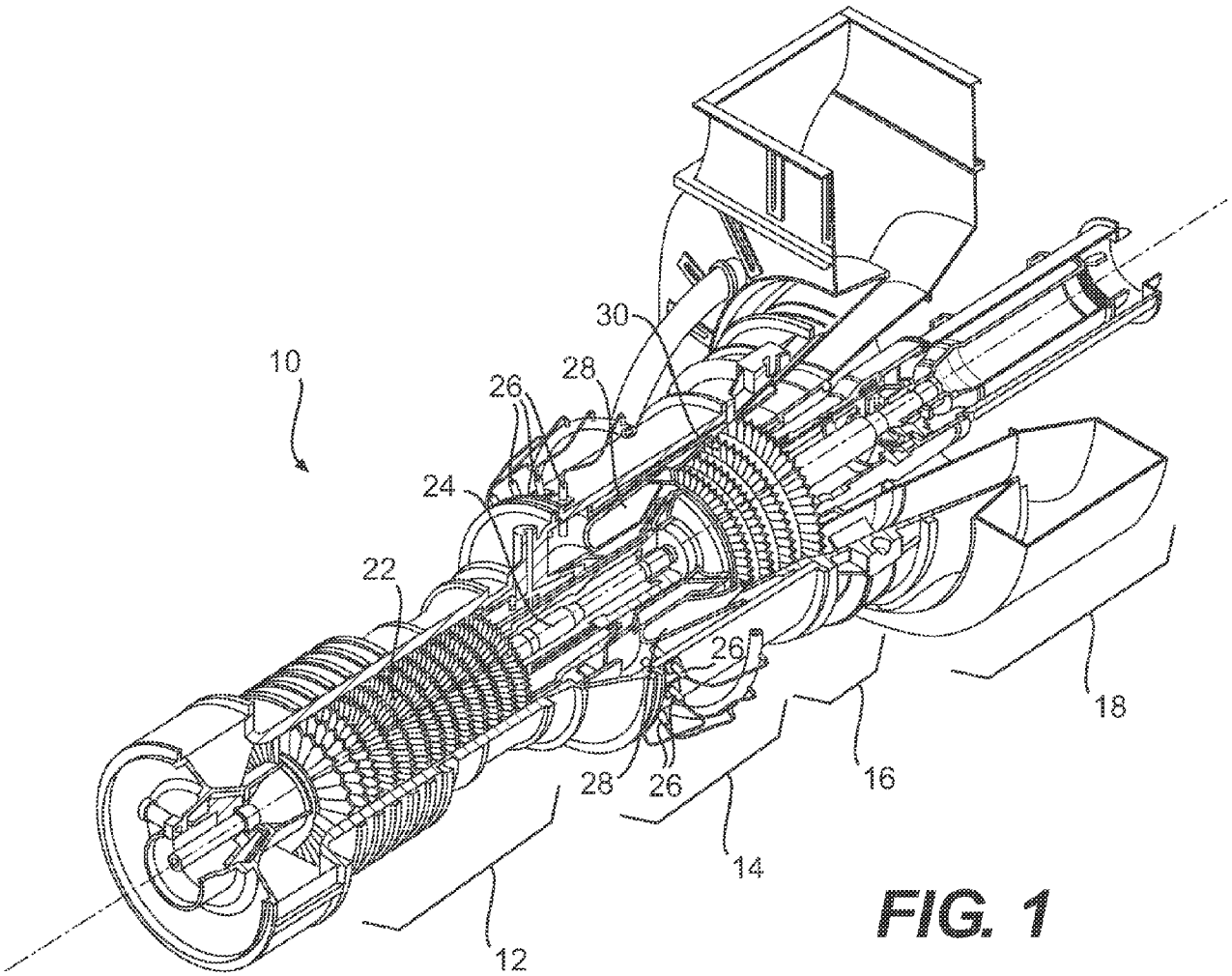
FIG. 1 is a cutaway-view illustration of an exemplary disclosed turbine engine.

FIG. 1 illustrates an exemplary turbine engine 10. Turbine engine 10 may be associated with a stationary or mobile work machine configured to accomplish a predetermined task. For example, turbine engine 10 may embody the primary power source of a generator set that produces an electrical power output or of a pumping mechanism that performs a fluid pumping operation. Turbine engine 10 may alternatively embody the prime mover of an earth-moving machine, a passenger vehicle, a marine vessel, or any other mobile machine known in the art. Turbine engine 10 may include a compressor section 12, a combustor section 14, a turbine section 16, and an exhaust section 18.

Compressor section 12 may include components rotatable to compress inlet air. Specifically, compressor section 12 may include a series of rotatable compressor blades 22 fixedly connected about a central shaft 24. As central shaft 24 is rotated, compressor blades 22 may draw air into turbine engine 10 and pressurize the air. This pressurized air may then be directed toward combustor section 14 for mixture with a liquid and/or gaseous fuel. It is contemplated that compressor section 12 may further include compressor blades (not shown) that are separate from central shaft 24 and remain stationary during operation of turbine engine 10.

Combustor section 14 may mix fuel with the compressed air from compressor section 12 and combust the mixture to create a mechanical work output. Specifically, combustor section 14 may include a plurality of fuel nozzles 26 annularly arranged about central shaft 24, and an annular combustion chamber 28 associated with fuel nozzles 26. Each fuel nozzle 26 may inject one or both of liquid and gaseous fuel into the flow of compressed air from compressor section 12 for ignition within combustion chamber 28. As the fuel/air mixture combusts, the heated molecules may expand and move at high speed into turbine section 16.

Figure 2:
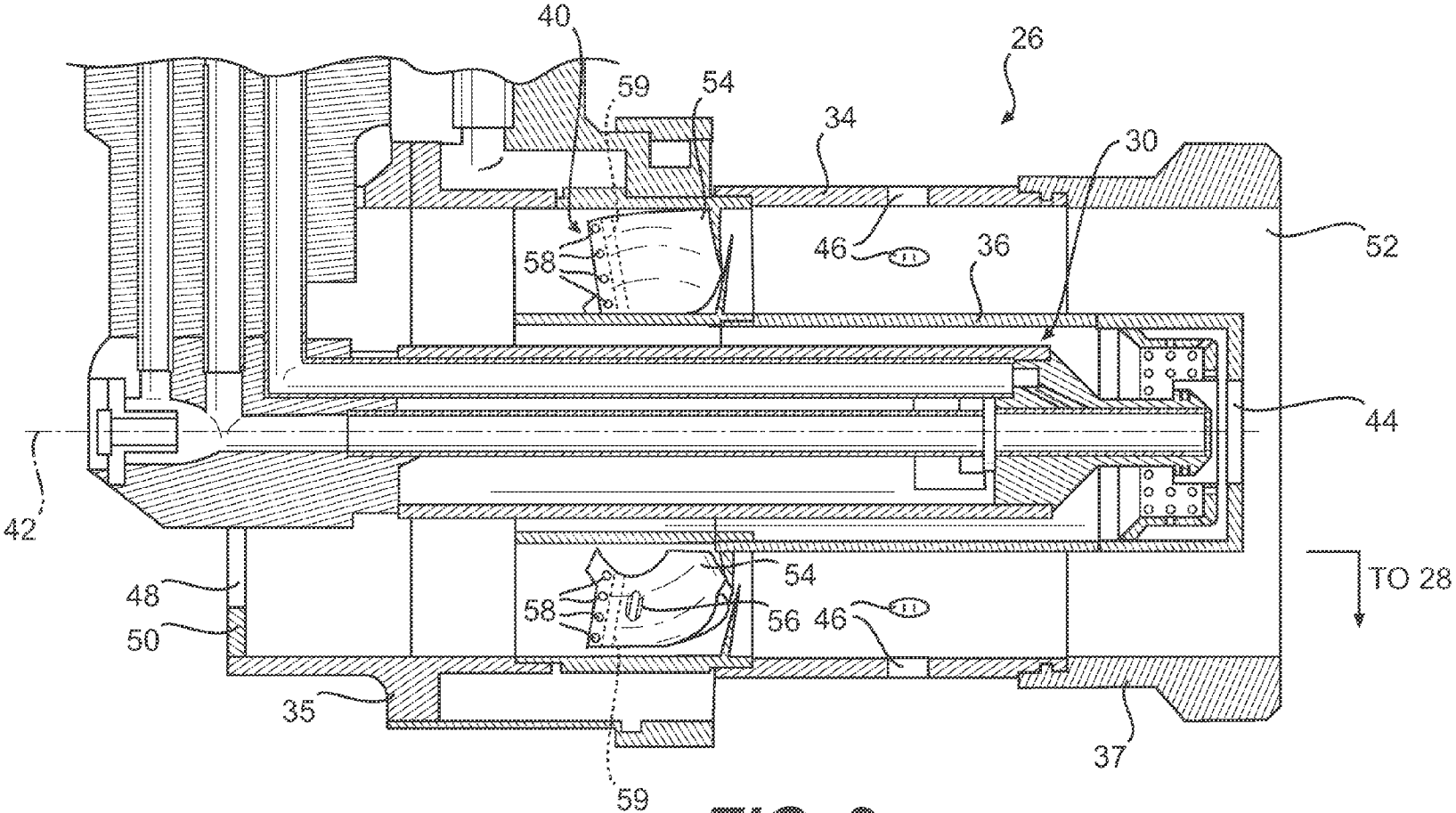
FIG. 2 is a cross-sectional illustration of an exemplary disclosed fuel nozzle for the turbine engine of FIG. 1.

As illustrated in the cross-section of FIG. 2, each fuel nozzle 26 may include components that cooperate to inject gaseous and liquid fuel into combustion chamber 28. Specifically, each fuel nozzle 26 may include a barrel housing 34 connected on one end to an air inlet duct 35 for receiving compressed air, and on the opposing end to a mixing duct 37 for communication of the fuel/air mixture with combustion chamber 28. Fuel nozzle 26 may also include a central body 36 with a pilot fuel injector, and a swirler 40. Central body 36 may be disposed radially inward of barrel housing 34 and aligned along a common axis 42. A pilot fuel injector may be located within central body 36 and configured to inject a pilot stream of pressurized fuel through a tip end 44 of central body 36 into combustion chamber 28 to facilitate engine starting, idling, cold operation, and/or lean burn operations of turbine engine 10. Swirler 40 may be annularly disposed between barrel housing 34 and central body 36.

Barrel housing 34 may embody a tubular member having a plurality of air jets 46. Air jets 46 may be co-aligned at a predetermined axial position along the length of barrel housing 34. This predetermined axial position may be set during manufacture of turbine engine 10 to attenuate a time-varying flow of air entering fuel nozzle 26 via air inlet duct 35. It is contemplated that air jets 46 may be located at any axial position along the length of barrel housing 34 and may vary from engine to engine or from one class or size of engine to another class or size of engine according to attenuation requirements. Air jets 46 may receive compressed air from compressor section 12 by way of one or more fluid passageways (not shown) external to barrel housing 34.

Air inlet duct 35 may embody a tubular member configured to axially direct compressed air from compressor section 12 (referring to FIG. 1) to barrel housing 34, and to divert a portion of the compressed air to air jets 46. Specifically, air inlet duct 35 may include a central opening 48 and a flow restrictor 50 located within central opening 48 at an end opposite barrel housing 34. In one example, flow restrictor 50 may embody a blocker ring extending inward from the interior surface of air inlet duct 35. The radial distance that flow restrictor 50 protrudes into central opening 48 may determine the amount of compressed air diverted around air inlet duct 35 to air jets 46 during operation of turbine engine 10. The amount of air diverted to air jets 46 may be less than the amount of air passing through air inlet duct 35. The geometry of air inlet duct 35 may such that pressure fluctuations within fuel nozzle 26 may be minimized to provide for piece-wise uniform flow through air inlet duct 35. In one example, air inlet duct 35 may be generally straight and may have a predetermined length. The predetermined length of air inlet duct 35 may be set during manufacture of turbine engine 10 according to an axial fuel introduction location and a naturally-occurring pressure fluctuation with combustion chamber 28. The method of determining and setting the length of air inlet duct 35 will be discussed in more detail below.

Mixing duct 37 may embody a tubular member configured to axially direct the fuel/air mixture from fuel nozzle 26 into combustion chamber 28. In particular, mixing duct 37 may include a central opening 52 that fluidly communicates barrel housing 34 with combustion chamber 28. The geometry of mixing duct 37 may be such that pressure fluctuations within fuel nozzle 26 are minimized to provide for piece-wise uniform flow through air inlet duct 35. In one example, mixing duct 37 may be generally straight and may have a predetermined length. Similar to air inlet duct 35, the predetermined length of mixing duct 37 may be set during manufacture of turbine engine 10 according to an axial fuel introduction location and the naturally-occurring pressure fluctuation within combustion chamber 28. The method of determining and setting the length of mixing duct 37 will be discussed in more detail below.

Swirler 40 may be situated to radially redirect an axial flow of compressed air from air inlet duct 35. In particular, swirler 40 may embody an annulus having a plurality of connected vanes 54 located within an axial flow path of the compressed air. As the compressed air contacts vanes 54, it may be diverted in a radially inward direction. It is contemplated that vanes 54 may extend from barrel housing 34 radially inward directly toward common axis 42 or, alternatively, to a point centered off-center from common axis 42. It is also contemplated that vanes 54 may be straight or twisted along a length direction and tilted at an angle relative to an axial direction of common axis 42.

Vanes 54 may facilitate fuel injection within barrel housing 34. In particular, some or all of vanes 54 may each include a liquid fuel jet 56 and a plurality of gaseous fuel jets 58. It is contemplated that any number or configuration of vanes 54 may include liquid fuel jets 56. The location of vanes 54 along common axis 42 and the resulting axial fuel introduction point within fuel nozzle 26 may vary and be set to, in combination with specific time-varying air flow characteristics, attenuate the naturally-occurring pressure fluctuation within combustion chamber 28. The method of determining and setting the axial fuel introduction point will be discussed in more detail below.

Gaseous fuel jets 58 may provide a substantially constant mass flow of gaseous fuel such as, for example, natural gas, landfill gas, bio-gas, or any other suitable gaseous fuel to combustion chamber 28. In particular, gaseous fuel jets 58 may embody restrictive orifices (i.e., gaseous fuel jets 58 may include an exit port comprising a restriction to the fuel exiting into barrel housing 34), situated along a leading edge of each vane 54. Each of gaseous fuel jets 58 may be in communication with a central fuel passageway 59 within the associated vane 54 to receive gaseous fuel from an external source (not shown). The restriction, i.e., exit port, at gaseous fuel jets 58 may be the greatest restriction applied to the flow of gaseous fuel within fuel nozzle 26, such that a substantially continuous mass flow of gaseous fuel from gaseous fuel jets 58 may be ensured.

Combustion chamber 28 (referring to FIG. 1) may house the combustion process. In particular, combustion chamber 28 may be in fluid communication with each fuel nozzle 26 and may be configured to receive a substantially homogenous mixture of fuel and compressed air. The fuel/air mixture may be ignited and may fully combust within combustion chamber 28. As the fuel/air mixture combusts, hot expanding gases may exit combustion chamber 28 and enter turbine section 16.

Turbine section 16 may include components rotatable in response to the flow of expanding exhaust gases from combustor section 14. In particular, turbine section 16 may include a series of rotatable turbine rotor blades 30 fixedly connected to central shaft 24. As turbine rotor blades 30 are bombarded with high-energy molecules from combustor section 14, the expanding molecules may cause central shaft 24 to rotate, thereby converting combustion energy into useful rotational power. This rotational power may then be drawn from turbine engine 10 and used for a variety of purposes. In addition to powering various external devices, the rotation of turbine rotor blades 30 and central shaft 24 may drive the rotation of compressor blades 22.

Exhaust section 18 may direct the spent exhaust from combustor and turbine sections 14, 16 to the atmosphere. It is contemplated that exhaust section 18 may include one or more treatment devices configured to remove pollutants from the exhaust and/or attenuation devices configured to reduce the noise associated with turbine engine 10, if desired.

Figure 3:
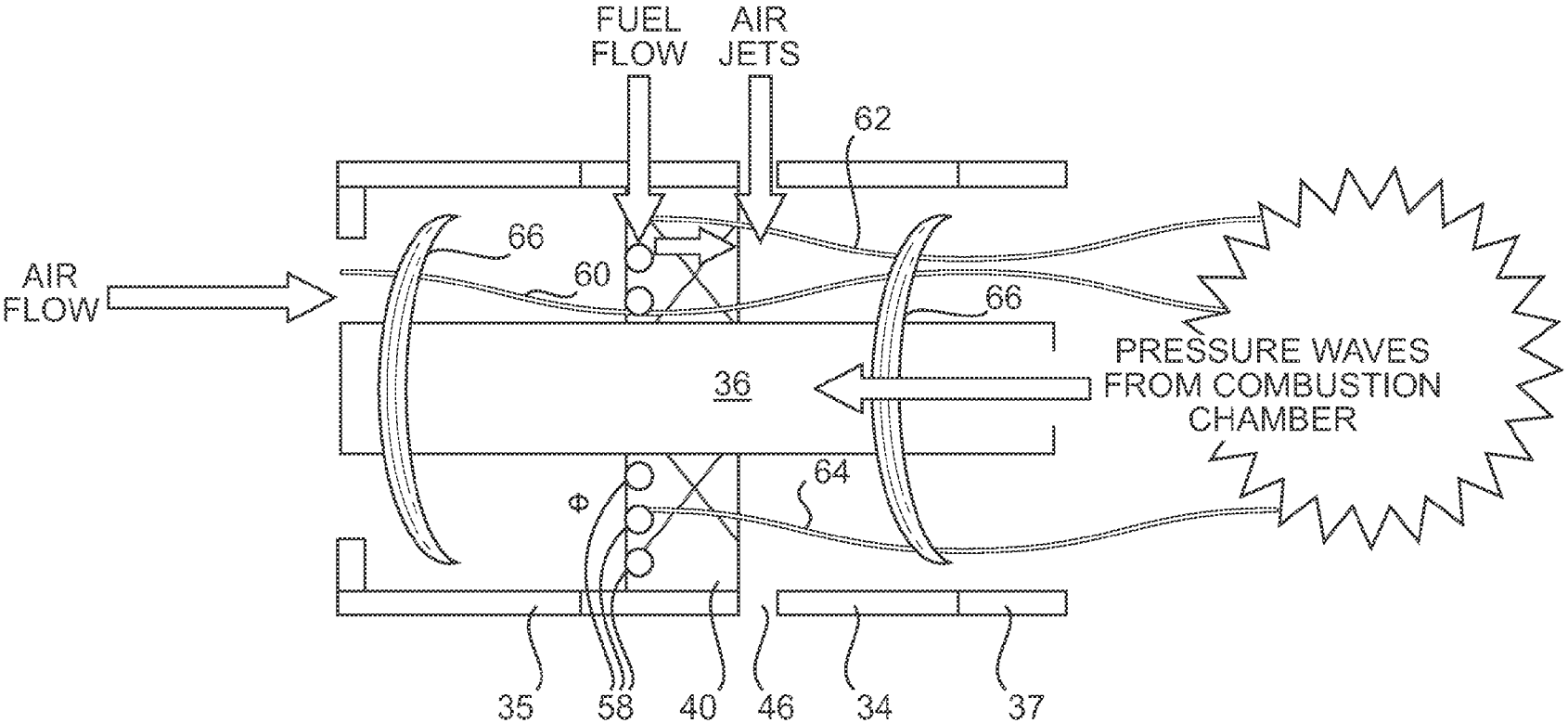
FIG. 3 is a pictorial representation of an exemplary disclosed operation of the fuel nozzle of FIG. 2.

FIG. 3 illustrates an exemplary relationship between the length of air inlet duct 35, the length of mixing duct 37, the axial fuel introduction point within barrel housing 34 resulting from the position of swirler 40 along common axis 42, and the naturally-occurring pressure fluctuation stemming from a flame front 67 within combustion chamber 28. FIG. 3 will be discussed in more detail below.

INDUSTRIAL APPLICABILITY

The disclosed fuel nozzle may be applicable to any turbine engine where reduced vibrations within the turbine engine are desired. Although particularly useful for low NOx-emitting engines, the disclosed fuel nozzle may be applicable to any turbine engine regardless of the emission output of the engine. The disclosed fuel nozzle may reduce vibrations by acoustically attenuating a naturally-occurring pressure fluctuation within a combustion chamber of the turbine engine. The operation of fuel nozzle 26 will now be explained.

During operation of turbine engine 10, air may be drawn into turbine engine 10 and compressed via compressor section 12 (referring to FIG. 1). This compressed air may then be axially directed into combustor section 14 and against vanes 54 of swirler 40, where the flow may be redirected radially inward. As the flow of compressed air is turned to flow radially inward, liquid fuel may be injected from liquid fuel jets 56 for mixing prior to combustion. Alternatively or additionally, gaseous fuel may be injected from gaseous fuel jets 58 for mixing with the compressed air prior to combustion. As the mixture of fuel and air enters combustion chamber 28, it may ignite and fully combust. The hot expanding exhaust gases may then be expelled into turbine section 16, where the molecular energy of the combustion gases may be converted to rotational energy of turbine rotor blades 30 and central shaft 24.

FIG. 3 illustrates the time-varying flow characteristics of fuel and air entering fuel nozzle 26 and their effects on the naturally-occurring pressure fluctuations within combustion chamber 28. In particular, FIG. 3 illustrates a first curve 60, a second curve 62, a third curve 64, and a plurality of pressure pulses 66. First curve 60 may represent the time-varying flow of compressed air entering fuel nozzle 26 via air inlet duct 35. Second curve 62 may represent the time-varying flow of fuel flow entering fuel nozzle 26 via liquid and/or gaseous fuel jets 56, 58. Third curve 64 may represent the time-varying fuel to air equivalence ratio Φ (e.g., the instantaneous ratio of the amount of fuel within any axial plane along the length of fuel nozzle 26 to the amount of air in the same axial plane). Pressure pulses 66 may represent a wave of pressure traveling from combustion chamber 28 in a reverse direction toward air inlet duct 35 as a result of combustion within combustion chamber 28.

Pressure pulses 66 may affect the time-varying characteristic of first, second, and third curves 60-64. Specifically, as pressure pulses 66 travel in the reverse direction within fuel nozzle 26 and reach liquid and gaseous fuel injectors 56, 58 and the entrance to air inlet duct 35, the pressure of each pulse may cause the flow rate of fuel and air entering fuel nozzle 26 to vary. These varying flow rates correspond to the amplitude variations of first and second curves 60, 62 illustrated in FIG. 3, which equate to the varying amplitude and phase angle of third curve 64. When the value of Φ at the point of combustion within combustion chamber 28 is high compared to a time average value of Φ, the heat release and resulting pressure wave within combustion chamber 28 may be high. Likewise, when the value of Φ at the point of combustion within combustion chamber 28 is low compared to the time average value of Φ, the heat release and resulting pressure wave within combustion chamber 28 may be low.

Damage may occur when the phase angle of third curve 64 and the wave of pressure pulses 66 near alignment. That is, when the value of Φ entering combustion chamber 28 is high compared to the time average of Φ and enters combustion chamber 28 at about the same time that a pressure pulse 66 initiates from a flame front with combustion chamber 28, resonance may be attained. Likewise, if the value of Φ entering combustion chamber 28 is low compared to the time average of Φ and enters combustion chamber 28 at a time between the initiation of pressure pulses 66, resonance may be attained. It may be possible that this resonance could amplify pressure pulses 66 to a damaging magnitude.

Damage may be prevented when third curve 64 and the wave of pressure pulses 66 are out of phase. In particular, if the value of Φ entering combustion chamber 28 is low compared to the time average of Φ and enters combustion chamber 28 at the same time that a pressure pulse 66 initiates from a flame front within combustion chamber 28, attenuation of pressure pulse 66 may be attained. Likewise, if the value of Φ entering combustion chamber 28 is high compared to the time average of Φ and enters combustion chamber 28 at a time between the initiation of pressure pulses 66, attenuation may be attained. Attenuation could lower the magnitude of pressure pulses 66, thereby minimizing the likelihood of damage to turbine engine 10.

The phase angle and magnitude of Φ may be affected by the length of air inlet duct 35, the length of mixing duct 37, the axial fuel introduction point, and the axial location of air jets 46. Specifically, by increasing the length of air inlet duct 35 (e.g., extending the entrance of air inlet duct 35 leftward, when viewed in FIG. 2), the phase angle of first curve 60 may likewise shift to the left. In contrast, by decreasing the length of air inlet duct 35 (e.g., moving the entrance of air inlet duct 35 to the right, when viewed in FIG. 2), the phase angle of first curve 60 may likewise move to the right. In fact, if the length of air inlet duct 35 becomes so short that the introduction of air is substantially coterminous with the introduction of fuel via gaseous fuel jets 58 and the pressure drops across flow restrictor 50 and gaseous fuel jets 58 are substantially constant, the phase angle and amplitude differences between first and second curves 60, 62 may be nearly zero, resulting in a substantially constant value of Φ. In addition, by extending the length of mixing duct 37 (e.g., extending the exit of mixing duct 37 rightward, when viewed FIG. 2), the phase angle of first curve 60 may move to the left. By decreasing the length of mixing duct 37 (e.g., moving the exit of mixing duct 37 leftward, when viewed in FIG. 2), the phase angle of first curve 60 may move to the right. By moving the location of swirler 40 left or right and, in doing so, the axial introduction point of gaseous and liquid fuel left or right, the phase angle of second curve 62 may mimic the same shifts. As the phase angle of one or both of first and second curves 60, 62 shifts, the phase angle and amplitude of third curve 64 may be affected. In this manner, the value of Φ entering combustion chamber 28 can be acoustically tuned to attenuate the naturally-occurring pressure pulses 66 of a specific engine or specific class or size of engine. It is contemplated that only one or both of the lengths of air inlet duct 35 and mixing duct 37 may be modified to attenuate the naturally-occurring pressure pulses 66.

Further reduction in the magnitude of pressure pulses 66 may be attained by providing a substantially time-constant value of Φ. One way to reduce the variation in the value of Φ may be to reduce the time-varying characteristic of first and/or second curves 60, 62. The time-varying characteristic of gaseous fuel introduced into combustion chamber 28 via gaseous fuel jets 58 may be reduced by way of the restriction at the surface of gaseous fuel jets 58. This restriction may increase the pressure drop across gaseous fuel jets 58 to a magnitude at which the pressure fluctuations within fuel nozzle 26 may have little affect on the flow of fuel through gaseous fuel jets 58. Another way to reduce the vibrations may be realized through the use of air jets 46. In particular, as seen in FIG. 3, when pulses of compressed air are introduced at a specific location within fuel nozzle 26 and at a timing out of phase with first curve 60, the time-varying characteristic of air entering combustion chamber 28 may be attenuated. In one example, the pulses of compressed air may be injected by air jets 46 substantially 180 degrees out of phase with first curve 60. The affect of the injected pulses of air can be seen in FIG. 3; as the flow of compressed air entering barrel housing 34 via air inlet duct 35 passes in proximity to air jets 46, the amplitude of first curve 60 may be reduced.

Several advantages over the prior art may be associated with fuel nozzle 26 of turbine engine 10. Specifically, because the length of air inlet duct 35, the length of mixing duct 37, and the axial fuel introduction point of turbine engine 10 may be selected specifically to attenuate the naturally-occurring pressure pulses of combustion chamber 28, harmful vibrations of turbine engine 10 may be greatly reduced. This acoustic tuning of turbine engine 10 may be more successful at reducing vibration than the random placement of apertures in an attempt to create non-resonating turbulence. In addition, these reductions in vibration may be attained with minimal changes to existing hardware, resulting in lower component costs of turbine engine 10.

It will be apparent to those skilled in the art that various modifications and variations can be made to the disclosed fuel nozzle. Other embodiments will be apparent to those skilled in the art from consideration of the specification and practice of the disclosed fuel nozzle. It is intended that the specification and examples be considered as exemplary only, with a true scope being indicated by the following claims and their equivalents.

We claim:

1. A fuel nozzle for a turbine engine having a compressor section and a combustion chamber, the fuel nozzle comprising:

a central body comprising a pilot fuel injector injecting a pilot stream of fuel through a tip end of central body and into the combustion chamber;

an air inlet duct and a mixing duct positioned about the central body helping to define an annular flow passageway between the air inlet duct and the mixing duct and the central body that in use communicates a flow of compressed air from the compressor section through the fuel nozzle out through the exit of the mixing duct and into the combustion chamber;

a swirler positioned between the air inlet duct and the mixing duct that swirls the compressed air passing in the annular flow passageway between the air inlet duct and the mixing duct;

a plurality of fuel jets to inject fuel into the compressed air passing though the annular flow passageway; and a plurality of circumferentially spaced air jets formed through the fuel nozzle between the swirler and the exit of the mixing duct, the air jets communicating additional compressed air from the compressor section into the annular flow passageway.

2. A fuel nozzle according to claim 1 wherein the plurality of fuel jets are formed in the swirler.

3. A fuel nozzle according to claim 2 wherein the plurality of fuel jets comprises a plurality of liquid fuel jets and a plurality of gaseous fuel jets.

4. A fuel nozzle according to claim 1 wherein the swirler comprises a plurality of vanes that extend outward from the central body and into the annular flow passageway.

5. A fuel nozzle according to claim 1 wherein the fuel jets comprises a restriction to the fuel exiting therefrom.

6. A fuel nozzle according to claim 1 wherein the air inlet duct further comprises a flow restrictor defining a central opening through which the compressed air entering air inlet duct passes, and the central opening and the air jets are sized so that a greater portion of the compressed air from the compressor section is passed through the air inlet duct than through the air jets.

7. A fuel nozzle according to claim 6 wherein the air jets direct compressed air radially inward toward the central body.

8. A fuel nozzle according to claim 7 wherein the plurality of fuel jets are formed in the swirler.

9. A fuel nozzle according to claim 8 wherein the plurality of fuel jets comprises both a plurality of liquid fuel jets and a plurality of gaseous fuel jets.

10. A fuel nozzle according to claim 1 wherein each of the plurality of circumferentially spaced air jets are positioned at the same axial position along the fuel nozzle.

11. A fuel nozzle for a turbine engine having a compressor section and a combustion chamber, the fuel nozzle comprising:

a central body comprising a pilot fuel injector injecting a pilot stream of fuel through a tip end of central body and into the combustion chamber;

an air inlet duct and a mixing duct positioned about the central body helping to define an annular flow passageway between the air inlet duct and the mixing duct and the central body that in use communicates a flow of compressed air from the compressor section through the fuel nozzle out through an exit of the mixing duct and into the combustion chamber;

a swirler positioned between the air inlet duct and the mixing duct that swirls the compressed air passing in the annular flow passageway between the air inlet duct and the mixing duct;

a plurality of fuel jets to inject fuel into the compressed air passing though the annular flow passageway; and a plurality of circumferentially spaced air jets formed through the fuel nozzle between the swirler and the exit of the mixing duct, the air jets communicating additional compressed air from the compressor section into the annular flow passageway;

wherein the air inlet duct and the plurality of fuel jets are configured such that a time varying change in the flow rate of compressed air flowing through the air inlet duct and a time varying change in the flow rate of fuel flowing through the plurality of fuel jets result in a substantially constant fuel/air ratio in a premixed fuel flow and air flow exiting the mixing duct.

12. A fuel nozzle according to claim 11 wherein the plurality of fuel jets are formed in the swirler.

13. A fuel nozzle according to claim 12 wherein the plurality of fuel jets comprises a plurality of liquid fuel jets and a plurality of gaseous fuel jets.

14. A fuel nozzle according to claim 11 wherein the air inlet duct further comprises a flow restrictor defining a central opening through which the compressed air entering air inlet duct passes, and the central opening and the air jets are sized so that a greater portion of the compressed air from the compressor section is passed through the air inlet duct than through the air jets.

15. A fuel nozzle according to claim 14 wherein the air jets direct compressed air radially inward toward the central body.

16. A fuel nozzle according to claim 15 wherein the plurality of fuel jets are formed in the swirler.

17. A fuel nozzle for a turbine engine having a compressor section and a combustion chamber, the fuel nozzle comprising:

a central body comprising a pilot fuel injector injecting a pilot stream of fuel through a tip end of central body and into the combustion chamber;

an air inlet duct and a mixing duct positioned about the central body helping to define an annular flow passageway between the air inlet duct and the mixing duct and the central body that in use communicates a flow of compressed air from the compressor section through the fuel nozzle out through an exit of the mixing duct and into the combustion chamber;

a swirler positioned between the air inlet duct and the mixing duct that swirls the compressed air passing in the annular flow passageway between the air inlet duct and the mixing duct;

a plurality of fuel jets to inject fuel into the compressed air passing though the annular flow passageway; and a plurality of circumferentially spaced air jets formed through the fuel nozzle between the swirler and the exit of the mixing duct, the air jets communicating additional compressed air from the compressor section into the annular flow passageway;

wherein the air inlet duct is spaced from the air jets such that a time varying flow rate of compressed air entering the fuel nozzle through the air inlet duct is out of phase with a time varying flow rate of compressed air entering through the air jets.

18. A fuel nozzle according to claim 17 wherein each of the plurality of circumferentially spaced air jets are positioned at the same axial position along the fuel nozzle.

19. A fuel nozzle according to claim 17 wherein each of the plurality of fuel jets are formed at substantially the same axial position along the fuel nozzle.

20. A fuel nozzle according to claim 19 wherein the plurality of fuel jets are formed in the swirler.

* * * * *